United States Patent [19]

Jessup et al.

[11] 4,044,829

[45] * Aug. 30, 1977

[54] METHOD AND APPARATUS FOR ANNULUS PRESSURE RESPONSIVE CIRCULATION AND TESTER VALVE MANIPULATION

[75] Inventors: Robert L. Jessup, Duncan, Okla.; Joe E. Coleman, New Orleans, La.

[73] Assignee: Halliburton Company, Duncan, Okla.

[ * ] Notice: The portion of the term of this patent subsequent to July 20, 1993, has been disclaimed.

[21] Appl. No.: 706,429

[22] Filed: July 19, 1976

Related U.S. Application Data

[62] Division of Ser. No. 540,361, Jan. 13, 1975, Pat. No. 3,970,147.

[51] Int. Cl.[2] ..... E21B 21/00; E21B 23/04; E21B 47/06

[52] U.S. Cl. ..... 166/264; 166/315; 166/323

[58] Field of Search ..... 166/319, 320, 321, 323, 166/324, 331, 150, 151, 152, 162, 250, .5, 264; 73/151

[56] References Cited

U.S. PATENT DOCUMENTS

| | | | |
|---|---|---|---|
| 2,591,087 | 4/1952 | Millican | 166/151 X |
| 2,855,952 | 10/1958 | Tausch et al. | 166/332 X |
| 3,025,919 | 3/1962 | Angel et al. | 166/321 X |
| 3,358,771 | 12/1967 | Berryman | 166/331 |
| 3,583,481 | 6/1971 | Vernotzy | 166/321 |
| 3,664,415 | 5/1972 | Wray et al. | 166/162 X |
| 3,750,752 | 8/1973 | Mott | 166/319 |
| 3,796,261 | 3/1974 | Nutter | 166/152 X |
| 3,814,182 | 6/1974 | Giroux | 175/242 X |
| 3,823,773 | 7/1974 | Nutter | 166/.5 |
| 3,970,147 | 7/1976 | Jessup et al. | 166/250 |

*Primary Examiner*—Stephen J. Novosad
*Attorney, Agent, or Firm*—John H. Tregoning

[57] ABSTRACT

A releasably locked closed circulation valve is introduced into a well bore as part of a drill string. The annulus between the drill string and the well bore, or casing affixed to the well bore, is sealed. Pressure is applied to the annulus and the valve unlocks and opens once the annulus pressure reaches a certain level to allow circulation between the annulus and the interior of the drill string. An optional locking device preferably locks the opened valve in the open position. A second embodiment includes a tester valve simultaneously operable with the circulation valve.

7 Claims, 7 Drawing Figures

METHOD AND APPARATUS FOR ANNULUS PRESSURE RESPONSIVE CIRCULATION AND TESTER VALVE MANIPULATION

This is a division of application Ser. No. 540,361 filed Jan. 13, 1975 now U.S. Pat. No. 3,970,147.

BACKGROUND OF THE INVENTION

1. Field of the Invention

This invention relates to a manipulation technique for valves of oil well test strings.

2. Description of the Prior Art

Annulus pressure responsive (hereafter called "APR") test-string manipulation is a relatively recent development in the art of oil well formation testing. U.S. Pat. No. 3,664,415 to Wray and Petty, assigned to the assignee of this invention, in 1972 disclosed a formation testing method and apparatus using variations in well annulus pressure to control the valving operation of a testing tool to entrap a formation sample. In formation testing, it is desirable to have a circulation valve, so that excess formation fluids present in the test string after testing may be forced out by pumping drilling mud or other displacement fluid down the well annulus and into the interior of the test string through the reverse circulation valve and upward toward the surface through the interior of the test string. This operation is called "reverse circulation."

A circulation valve is also desirable to allow a flow path for fluids trapped in a test string above a closed valve, such as a tester valve for taking closed-in pressures, so that such fluids may pass into the wellbore upon pulling the pipe string from the well. This avoids having to contend with such well fluids at the wellhead. It would be a most disagreeable task to have to separate thousands of feet of pipe sections full of well fluids due to the absence of a properly functioning reverse circulation valve capable of allowing the fluids to "dump" into the well as noted above.

Four types of reverse circulation valves are currently used in test strings: the rotating valve, the impact-sub valve, the reciprocal valve and the pump-out plug valve.

The rotating valve is operated by rotation of the test string to open a reverse circulation port. This requires opening of blow-out preventer rams and rotating the pipe, which can be difficult if the pipe is in a bind as in the case of a deviated hole, and which could be catastrophic should the well "blow" during the rotational operation. Likewise, a reciprocally operated valve is subject to difficulties in deviated holes.

An impact-sub type circulating valve requires dropping a bar which might hit ledges inside the pipe or have to fall through very viscous fluid and such a sub must be placed above any blind-type valve in the string.

The pump-out type circulating valve might require internal pressure significantly higher than annulus pressure in order to open. In cases where annulus pressure is already high, such as where APR test tools are used, or it is undesirable to load the running string for hydraulic pressure application, a pump-out type valve might not be desirable.

Considering said limitations, APR circulating valves have been developed to overcome the above noted difficulties, which are especially important in offshore oil well formation testing, and so as to be compatible with other APR testing tools and operable by essentially the same surface equipment.

One solution to the above problems is a pressurized gas-biased annulus pressure responsive reverse circulating valve operated by multiple pressurizations and depressurizations of the well annulus as disclosed in pending application Ser. No. 288,187 by Holden et al., filed Sept. 11, 1972, now U.S. Pat. No. 3,850,250 issued Nov. 26, 1974 and assigned to the assignee of this application.

Another solution to the above problems and others is provided by the apparatus of the present invention, which provides a simple, inexpensive, reliable APR valve.

BRIEF SUMMARY OF THE INVENTION

The invention provides a method and apparatus for annulus pressure responsive valve manipulation. The method comprises the steps of introducing a closed substantially unbiased circulation valve into a well bore maintaining the valve in the closed position while pressurizing the well annulus, opening the valve in response to a predetermined annulus pressure, and maintaining said valve in the open position. The apparatus comprises a housing having an axial passage therethrough and a radial port communicating the exterior of the housing with the axial passage; sleeve means, carried by the housing; a first locking means, connecting said housing and said sleeve means for holding said sleeve means in a first position; and piston means, attached to said sleeve means for moving said sleeve to a second position.

BRIEF DESCRIPTION OF THE DRAWINGS

The apparatus of this invention is more fully described in the attached drawings which include:

Referring to FIG. 1, a pipe string 1 can be suspended from a subsea test tree 2 connected to a floating vessel 3 by conduit 4. Pipe string 1 includes pipe 5, supporting slip joint 6 and slip joint safety valve 7 which in turn supports pipe 8 connected to and supporting an APR circulating valve 9. APR circulating valve 9 is in turn connected to and supports an APR tester valve 10 which can be of the type disclosed in U.S. Pat. No. 3,664,415, application Ser. No. 443,599, filed Feb. 19, 1974, now U.S. Pat. No. 3,860,069, issued Jan. 14, 1975 or Ser. No. 412,881, filed Nov. 15, 1973, now U.S. Pat. No. 3,856,085, issued Dec. 24, 1974 all assigned to the assignee of this invention. APR testing valve 10 can support and be connected to a reciprocally operated tester valve 11 of the type as disclosed in U.S. Pat. No. 3,814,182, such reciprocally operated valve serving as a back-up tester valve in case of premature opening of APR tester valve 10. Reciprocally operated tester valve 10 can then be connected to auxiliary testing tools 12. Auxiliary testing tools 12 can include a packer 13 or other means for sealing the annulus 14 between the pipe string 1 and a surrounding well bore 15 in which said pipe string 1 is suspended. When viewing FIG. 1, it will be understood that floating vessel 3 and the upper part 4*a* of conduit 4 are shown in a scale much reduced from that in which the lower part 4*b* of conduit 4 and the pipe string 1 and subsea tree 2 are shown.

Referring now to FIG. 2, the structure of one preferred embodiment of the invention will be described in detail. FIG. 2 generally shows the APR circulating valve 9 of FIG. 1 in the closed position. APR circulating valve 9 comprises generally cylindrical housing 16, valve mandrel 17 concentrically carried within housing 16, shear mechanism 18 attaching the housing 16 to the mandrel 17, a lock 19 carried by housing 16 and placed between housing 16 and mandrel 17, and a piston assembly 20 comprising certain portions of the mandrel 17 and housing 16. APR circulating valve 9 is shown inverted in FIG. 1 to emphasize that valve 9 may be reversed without altering its function.

Housing 16 comprises an upper adapter 21, a lower adapter 22, a central shell 23 therebetween and a bushing 24.

Figure 1:
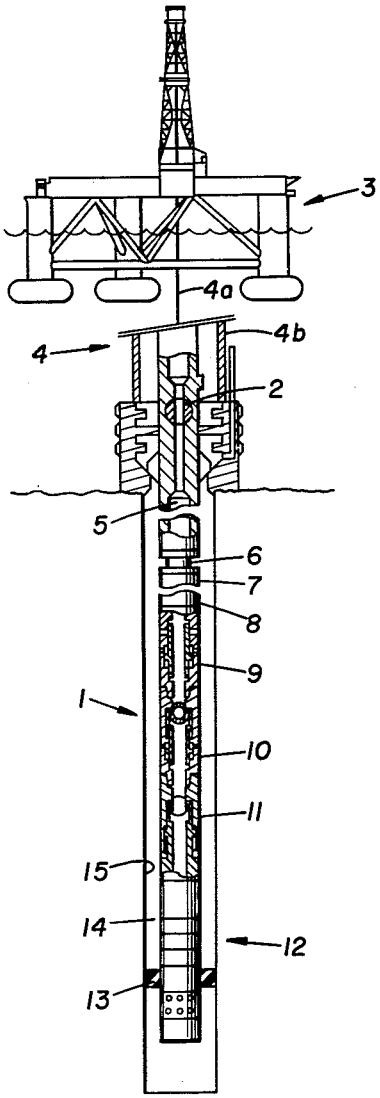
FIG. 1, a schematic elevational view of a typical well testing apparatus using the invention.

Upper adapter 21 comprises a cylinder with a vertical axial bore 25 therethrough, said bore 25 communicating with the bore of pipe 8 of FIG. 1. The upper portion 26 of upper adapter 21 is threaded internally to allow for connection to pipe 8 of FIG. 1. An axial counterbore 27 of diameter larger than axial bore 25 is formed in the lower portion 28 of upper adapter 21 to produce an annular shoulder 29. A threaded external recess 30 is formed in the lower portion 28 of upper adapter 21. Annular shoulder 29 can be provided with mandrel rim cushion 93 to cushion upward movement of mandrel 17 within housing 16.

Central shell 23 comprises a cylinder having upper internally threaded end 31 and lower internally threaded end 32 and an axial bore 33 connecting said threaded ends 31 and 32. Upper threaded end 31 of central shell 23 is threadedly and externally connected to the threads of threaded recess 30 of upper adapter 21, to produce an annular shoulder 34.

Lower adapter 22 comprises a cylinder having an axial bore 35 of approximately the same diameter as axial bore 25 of upper adapter 21. The lower portion 36 of lower adapter 22 can have an axial counterbore 37 of diameter greater than axial bore 35. A first axial counterbore 39 of a diameter greater than axial bore 35 is formed in the head portion 38 of lower adapter 22 to produce a first annular ledge 40. A second axial counterbore 41, of diameter greater than axial counterbore 39, is formed in middle section 42 of the head portion 38 of lower adapter 22 to produce a second annular ledge 43. A third axial counterbore 44, of diameter greater than the diameter of second axial counterbore 41, is formed in the upper section 45 of the head portion 38 of lower adapter 22 to produce a third annular ledge 46. A fourth axial counterbore 47, of diameter greater than the diameter of third axial counterbore 44, is formed in the top section 48 of lower adapter 22 to produce a fourth annular ledge 49. The topmost section 50 of lower adapter 22 is internally threaded with internal threads 51 adapted to receive corresponding external threads 52 of bushing 24. Head portion 38 of lower adapter 22 has an external recess 53 extending from the top rim 54 of lower adapter 22 downward along the exterior of topmost section 50, top section 48, upper section 45 and the upper part 55 of middle section 42. The lower portion 56 of recess 53 has external threads 57 adapted to receive the lower threaded end 32 of central shell 23, while the upper portion 58 is smooth and has an outside diameter less than the diameter of bore 33 of central shell 23 so as to fit within bore 33 when internally threaded end 32 is threaded onto external threads 57. Middle section 42 of head portion 38 of lower adapter 22 has a plurality of circulation ports 59 communicating second axial counterbore 41 with the exterior 60 of lower adapter 22, so as to allow fluid circulation therebetween when unobstructed.

Bushing 24 is a cylinder with an axial bore 61 of a diameter substantially the same as the diameter of second axial counterbore 41 of head portion 38 of lower adapter 22 and an external recess 62. Recess 62 has external threads 52 and is of axial length substantially the same as topmost section 50 of head portion 38 of lower adapter 22, so as to produce an annular shearing ledge 63 when threaded to internal threads 51 of topmost section 50.

Mandrel 17 is a cylinder with an axial bore 64 of substantially the same diameter as both axial bore 25 of upper adapter 21 and axial bore 35 of lower adapter 22. Mandrel 17 is of axial length sufficient to reach from first annular ledge 40 of lower adapter 22 to above shoulder 34 of housing 16. Mandrel 17 comprises an upper portion 65 and a lower portion 66 and a piston portion 67 therebetween. Mandrel 17 can be internally pressure balanced by making axial counterbores 27 and 39 of equal diameter and upper and lower portions 65 and 66 of equal annular cross-section.

The upper portion 65 has an external diameter slightly less than the diameter of axial counterbore 27 of the lower portion 28 of upper adapter 21 so as to allow upper portion 65 to slide within counterbore 27. An upper mandrel seal 68 is placed in a groove 75 just below the top rim 69 of mandrel 17, so as to prevent fluid passage between upper portion 65 and axial counterbore 27.

Lower portion 66 of valve mandrel 17 comprises a top section 70 and a bottom section 71. Top section 70 has an external diameter less than bore 61 of bushing 24 and slightly less than the diameter of second axial counterbore 41 of head portion 38 of lower adapter 22, but of greater diameter than first axial counterbore 39 of head portion 31. Top section 70 is of sufficient length to reach from the top rim 82 of bushing 24 to a distance X below fourth annular ledge 49, for reasons to be explained below. Bottom section 71 of lower portion 66 has an external diameter slightly less than the diameter of first axial counterbore 39, but greater than the diameter of axial bore 35 so that downward movement of the bottom rim 72 of valve mandrel 17 is limited by first annular ledge 40 of lower adapter 22. An annular locking shoulder 90 is formed between top secton 70 and bottom section 71 due to the difference in their respective external diameters. Bottom section 71 is provided with a groove 73 containing a bottom mandrel seal 73 so as to prevent fluid passage between bottom section 71 and first axial counterbore 39 when valve mandrel 17 is in the position shown in FIG. 2.

Piston portion 67 comprises a radial ledge 76 and piston seal 77. Radial ledge 76 projects radially outward from valve mandrel 17 betwen top portion 65 and bottom portion 66. Radial ledge 76 is of a diameter slightly less than the diameter of axial bore 33 of central shell 23 but greater than either axial bore 61 of bushing 24 or axial counterbore 27 of upper adapter 21. The external surface 78 of ledge 76 is provided with a groove 99 with a piston seal 77 therein, so that fluid passage between axial bore 33 and external surface 78 is prevented. The top surface 81 of radial ledge 76 can be provided with piston cushion 94 to cushion upward movement of radial ledge 76 as surface 81 approaches shoulder 34 of housing 16. Radial ledge 76 divides the annular chamber between mandrel 17 and housing assembly 16 into an isolated upper low pressure chamber 79 and a lower annulus pressure chamber 80. Low pressure chamber 79 is axially located between shoulder 34 of housing 16 and the upper surface 81 of radial ledge 76 and radially located between upper portion 65 of mandrel 17 and counterbore 33 of central shell 23. Annulus pressure chamber 80 is axially located between second annular ledge 43 of lower adapter 22 and bottom surface 83 of radial ledge 76 and radially located between housing 16 and lower portion 66 of mandrel 17. Annulus pressure chamber 80 is in fluid communication with well annulus 14 of FIG. 1 via port 59 of lower adapter 22 and via one or more pressurization ports 84 through central shell 23 at a point just above the level of top rim 82 of bushing 24 when assembled. Low pressure chamber 79 can be isolated from both annulus 14 and axial bores 64 and 25.

Lower portion 66 of valve mandrel 17 has one or more shear pin holes 85 located at a point on lower portion 66 which is opposite fourth axial counterbore 47 of head portion 38 of lower adapter 22 when bottom rim 72 of valve mandrel 17 is in contact with first annular ledge 40 of lower adapter 22.

Figure 2:
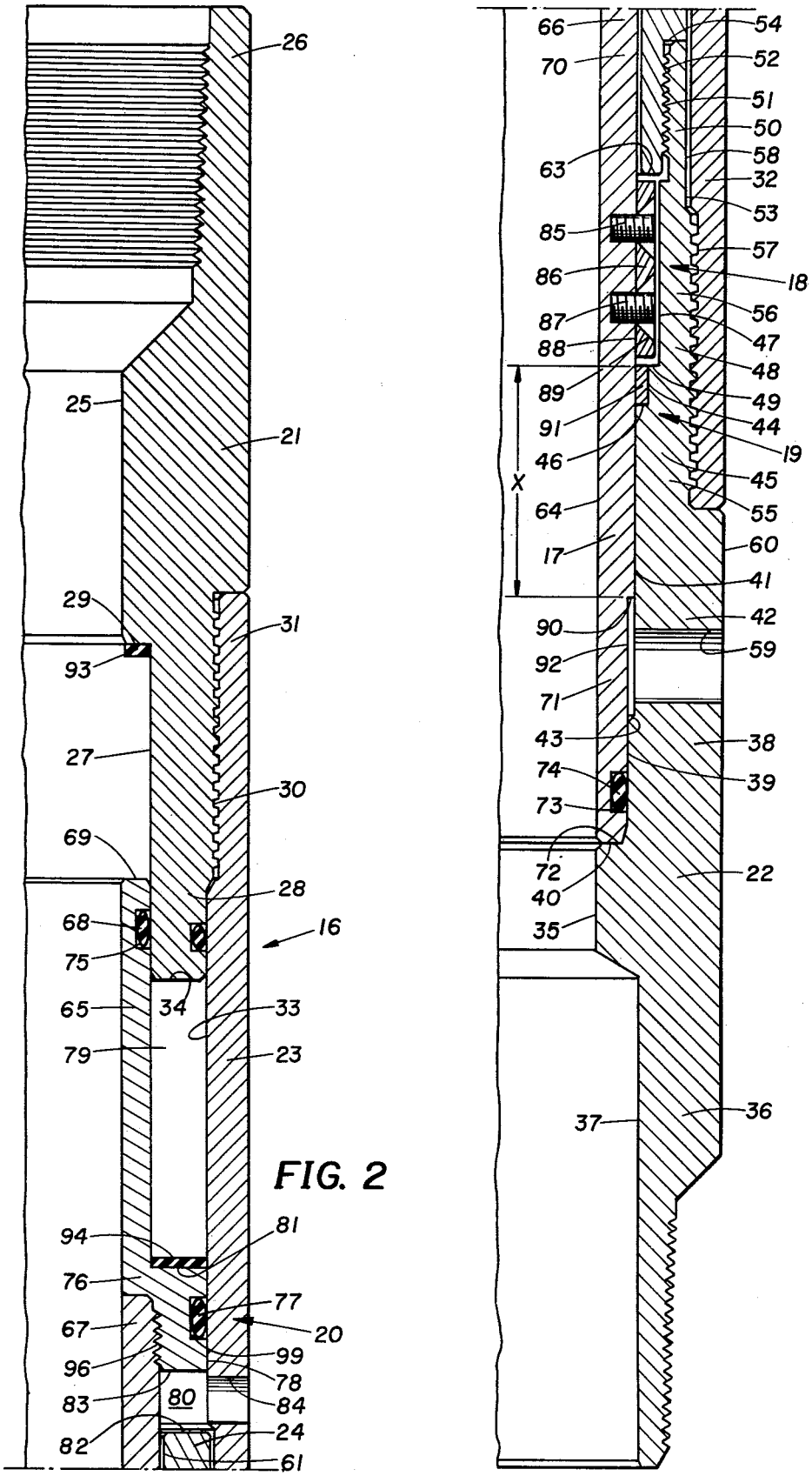
FIG. 2, a right side only cross-sectional view of a first embodiment of the invention in the closed position.

Referring to FIG. 2, shear mechanism 18 comprises shear pin holes 85, shear collar 86, shear pins 87, and annular shearing ledge 63. Shear collar 86 is a cylinder with an axial bore 88 and a plurality of shearing holes 89 communicating axial bore 88 with the external surface of shear collar 86. One or more shearing holes 89 of shear collar 86 is aligned with one or more shear pin holes 85 of lower portion 66 of valve mandrel 17 and one or more shear pins are each inserted into both a shearing hole 89 and an aligned shear pin hole 85 so as to shearably connect valve mandrel 17 to shear collar 86. The number of shear pins utilized can be varied as necessary to obtain a desired resistance to opening. The determination of this number would include such considerations as: hydrostatic pressure expected, operating pressure for other APR tools and pipe strength. Shear collar 86 is located between annular shearing surface 63 of bushing 24 housing 16 and fourth annular ledge 49 of lower adapter 22, so that upward movement of shear collar 86 will be restrained by shearing surface 63. However, upward movement of valve mandrel 17 is not restrained by shearing surface 63 but rather by shear pins 87, so that sufficient upward force on lower surface 83 of radial ledge 76 of valve mandrel 17 will shear the shear pins 87 and allow mandrel 17 to move upwardly even though shear collar 86 continues to be restrained as above described.

Figure 7:
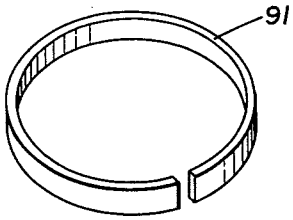
FIG. 7, a perspective view of the locking ring of the embodiments of FIGS. 2, 3, 4 and 5.

Referring to FIG. 2 and FIG. 7, the lock 19 comprises an annular locking shoulder 90 and a lock ring 91. Lock ring 91 is a split ring having an internal diameter, when fully expanded, at least as great as the external diameter of upper section 70 of the lower portion 66 of mandrel 17 and having a diameter when fully relaxed of as least as small as the external diameter of bottom section 71 of lower portion 66 of mandrel 17. Locking ring 91 is placed in third axial counterbore 44 of head portion 38 of lower adapter 22 and abuts third annular ledge 46 of lower adapter 22.

Figure 3:
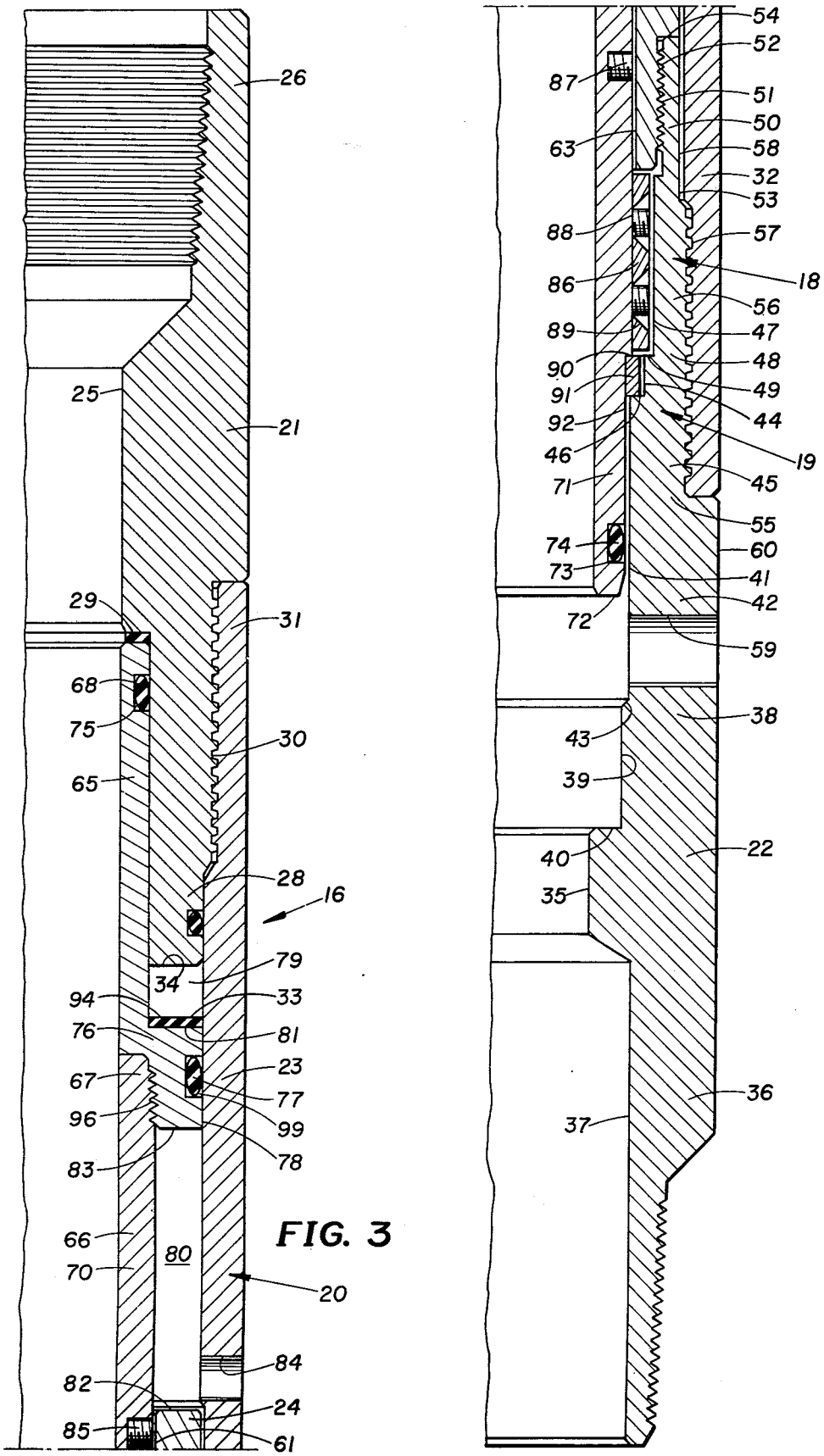
FIG. 3, a right side only cross-sectional view of the first embodiment of the invention in the open position.

Upward movement of lock ring 91 is restrained by shear collar 86 which is restrained by bushing 24 of housing 16. Thus when valve mandrel 17 moves upward, as shown in FIG. 3, lock ring 91 stays in place until valve mandrel 17 has moved, as shown in FIG. 3, more than a distance X, at which time the lock ring is adjacent the external surface 92 of bottom section 71 of the lower portion 66 of mandrel 17 and therefore can relax (contract) and thereby pass under annular locking ledge 90 of valve mandrel 17. Downward movement is thereby restrained since locking ledge 90 cannot be lowered past locking ring 91.

Referring still to FIG. 2, piston assembly 20 comprises annular ledge 76, annulus pressure chamber 80, ports 84 and 59, seals 68, 74 and 77, and low pressure chamber 79. The structure and location of ledge 76, chambers 79 and 80, ports 59 and 80, and seals 68, 74 and 77 have previously been described. As pressure in the well annulus 14 of FIG. 1 is increased, that pressure acts via ports 59 and 84 upon bottom surface 83 of annular ledge 76 and upon annular locking ledge 90, thereby tending to force valve mandrel upward against the restraint of shear pins 87. Upper surface 81 is acted upon by only the negligible pressure of low pressure chamber 79.

Figure 6:
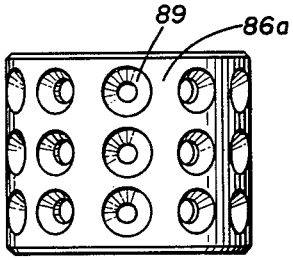
FIG. 6, a perspective view of the shear collar of the embodiment of FIG. 4.
Figure 4:
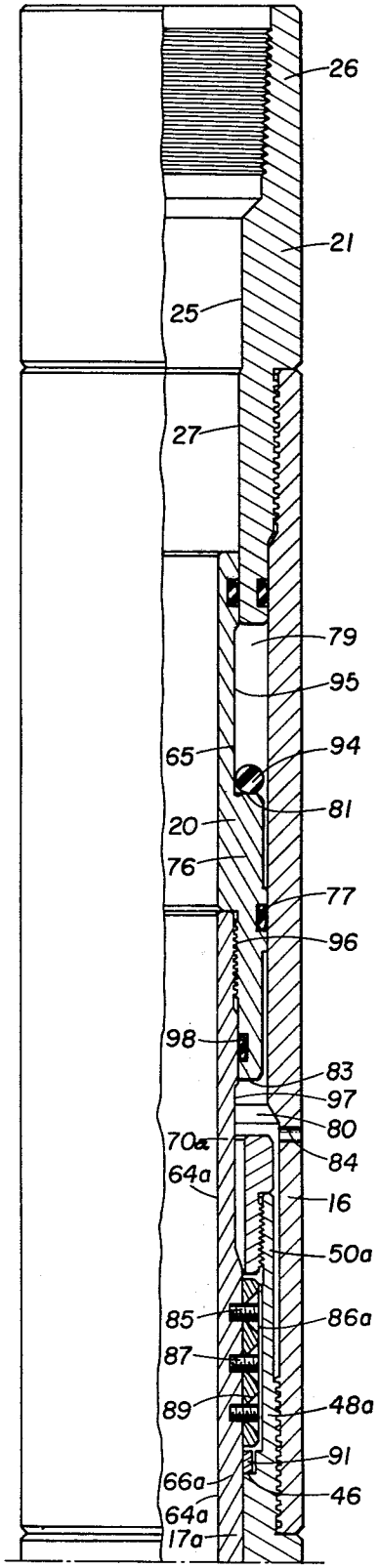
FIG. 4, a right side only cross-sectional view of a second embodiment of the invention in the closed position.
Figure 4:
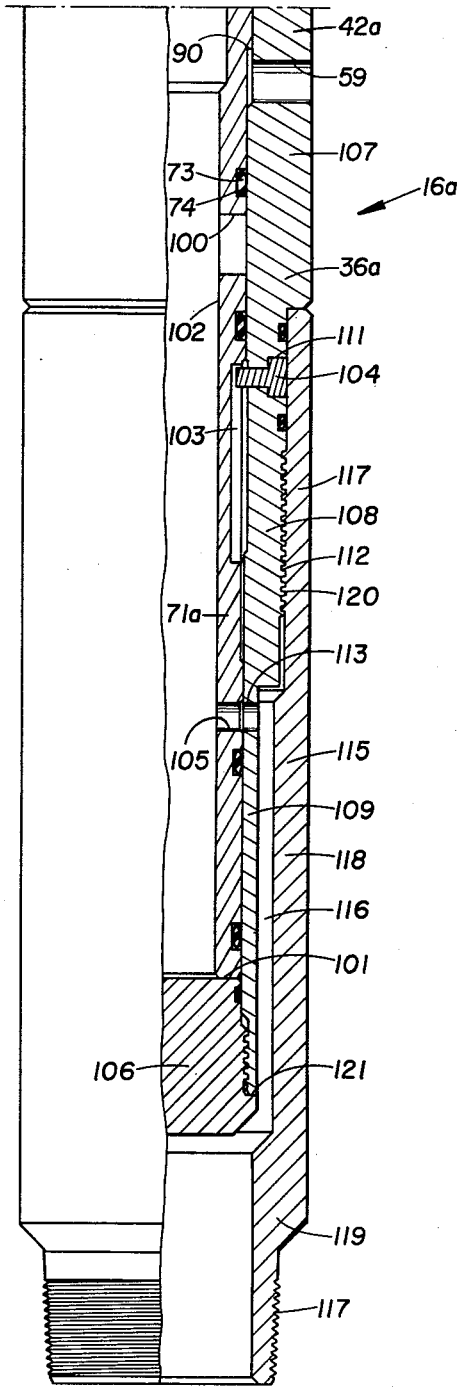

Referring to FIG. 1 and FIG. 4, an alternative embodiment of the APR circulating valve 9 of FIG. 1 so as to incorporate an APR tester valve will be described. Mandrel **17*a* has been split by threads 96 so as to facilitate disassembly thereof. Referring to FIG. 4, it will be noted also that counterbore 27 of the upper adapter 21 of FIG. 2 has been extended axially through upper adapter 21 to eliminate axial bore 25 and annular shoulder 29 so as to provide a less restricted fluid passageway through upper adapter 21. Upward movement of the mandrel 17*a* is thus restrained by upper annular surface 81 of radial ledge 76 and not by annular shoulder 29. The upper portion 65 of mandrel 17*a* has been provided with an annular recess 95 to provide a space for the gas in low pressure chamber 79 when mandrel 17*a* is in its upper position. The upper section 70*a* of the bottom portion 66*a* of mandrel 17*a* has been provided with an annular recess 97 from just below bottom surface 83 of radial ledge 76 down to just above shear pin holes 85, so as to increase the size of annulus pressure chamber 80. Shear collar 86*a* has been enlarged from shear collar 86 of FIG. 1 so as to accept another row of shearing holes 89. This modified shear collar 86*a* is shown in FIG. 6. Mandrel 17*a* has been provided with a corresponding additional row of shear pin holes 85 to allow greater pressures to be applied to the annulus 14 of FIG. 1 without shearing of shear pins 87**.

The major distinction of the valve of FIG. 4 from that of FIG. 2 is the addition of a tester valve feature for closing off axial bore **64*a* so as to allow the taking of a closed-in-pressure reading of the formation's ability to produce. In this instance APR tester valve 10 of FIG. 1 could be deleted unless desired for multiple closed-in-pressure readings. Looking to FIG. 4 it is seen that bottom section 71*a* of lower portion 66*a* of mandrel 17*a* is much longer than bottom portion 71, so as to incorporate a tester valve. Bottom portion 71*a* of mandrel 17*a* can have an axial bore 102 of a diameter less than the diameter of axial bore 64*a* of the upper section 70*a* of the lower portion 66*a* of mandrel 17*a*. One or more circulation ports 100** extend radially through bottom section 71*a*, and are each so positioned as to be substantially aligned with a port 59 of housing 16*a* after upward movement of mandrel 17*a* as below described. Bottom section 71*a* is also provided with one or more external grooves 103 to assure the alignment of circulation ports 59 and 100, grooves 103 are adapted to receive a stud 104 or other projection to prevent rotation of the mandrel 17*a* relative the housing 16*a*. Bottom section 71*a* also has a tester port 105, for reasons below described. Mandrel 17*a* extends downwardly to bottom rim 101 which rests on a tester plug 106, described below.

Housing 16*a* of FIG. 4 extends downwardly around bottom section 17*a*. Lower adapter 22 of FIG. 2 is replaced by nipple 107, which has a topmost section 50*a*, top section 48*a*, and middle section 42*a* substantially the same as that of lower adapter 22, but has a lower portion 36*a* much different. Lower portion 36*a* comprises a first region 108 and a second region 109. First region 108 can be provided with a stud hole 111 adapted to hold stud 104 and with external threads 112. Second region 109 is of reduced external diameter relative to first region 108 and contains tester port 113. Port 113 is aligned with tester port 105 of mandrel 17*a* so as to allow fluid communication between the exterior of region 109 and axial bore 102 of portion 71*a* of mandrel 17*a*. Second region 109 is also provided with internal threads 114 adapted to receive plug 106.

A bottom adapter 115 is included in housing 16*a* of FIG. 4, to form a flow channel 116 and provide threads 117 for connection of other tools or pipe. Bottom adapter 115 comprises an upper section 117, middle section 118, and a lower section 119. Upper section 117 has an external diameter approximately the same as that of nipple 107 and is provided with internal threads 120 adapted to engage with threads 112 of nipple 107. Middle section 118 has an internal diameter sufficiently greater than the external diameter of second region 109 of lower portion 36*a* of nipple 107 to allow annular flow channel 116 of approximately the same cross-sectional area as axial bore 102. Lower section 119 is provided with threads 117 as aforementioned. Plug 106 can be threaded to the interior of second region 109 of nipple 107. When so threaded, plug 106 blocks fluid passage through the lower end 121 of nipple 107, thus creating an open sleeve valve out of bottom portion 71*a* of mandrel 17*a* and second region 109 of lower portion 36*a* of nipple 107.

Referring to FIGS. 1, 2 and 3, the operation of APR circulating valve 9 will be described. Referring first to FIG. 1, and by way of introduction to said operation of valve 9, drill string 1 is lowered into the well bore 15 to a desired position for formation testing and testing is conducted by use of auxiliary testing tools 13, valves 9 and 10 and valve 11. Before this testing is begun, auxiliary testing tools 13 isolate the well annulus 14 so as to allow the application of pressure to annulus 14 without affecting formations below, and to allow the annulus to be pressurized to operate an APR tool in drill string 1. After the formation is tested and reverse circulation is desired, or even if reverse circulation is desired without the formation having been tested, the annulus 14 is pressurized sufficiently to operate APR reverse circulation valve 9 of drill string 1.

Referring now to FIGS. 1, 2, and 3, the specific operation of APR circulating valve 9 will be described. When annulus 14 is pressurized, it can be seen that such pressure will act upon bottom surface 83 of radial ledge 76 of valve mandrel 17, since ports 59 and 84 in housing 16 allow fluid communication between annulus 14 and surface 83. This pressure creates an upward force on mandrel 17, which in turn puts a shear force on shear pins 87, due to the restraint of shear pins 87 by shear collar 86, as previously described. The magnitude of the annulus pressure necessary to shear the shear pins 87 depends on the number of shear pins 87, and this number would have been set at an appropriate figure in consideration of hydrostatic pressure, operating pressures of other APR tools and pipe strength. When such shear force reaches a level in excess of the shear strength of shear pins 87, the shear pins 87 are sheared and, as shown in FIG. 3, mandrel 17*a* moves upward under the motive force of the annulus pressure upon surface 83, to uncover circulation port 59 and thereby place axial bores 64, 35 and 27 in fluid communication with annulus 14, thereby allowing circulation between annulus 14 and the internal bore of drill string 1 of FIG. 1.

This upward movement of mandrel 17 expands annulus pressure chamber 80 and contracts low pressure chamber 79, since seal 77 prevents fluid passage therebeteen, as previously described. When locking shoulder 90 of lower portion 66 of valve mandrel 17 passes upward a sufficient distance to be above locking ring 91, ring 91 will contract and seat under shoulder 90 yet still be seated on third annular ledge 46 of lower adapter 22 of housing 16. Locking ring 91, in this position will prevent downward movement of mandrel 17. Since mandrel 17 is now locked-open the annulus pressure operating on shoulder 83 may be reduced completely without valve mandrel 17 recovering the circulation port 59.

Figure 5:
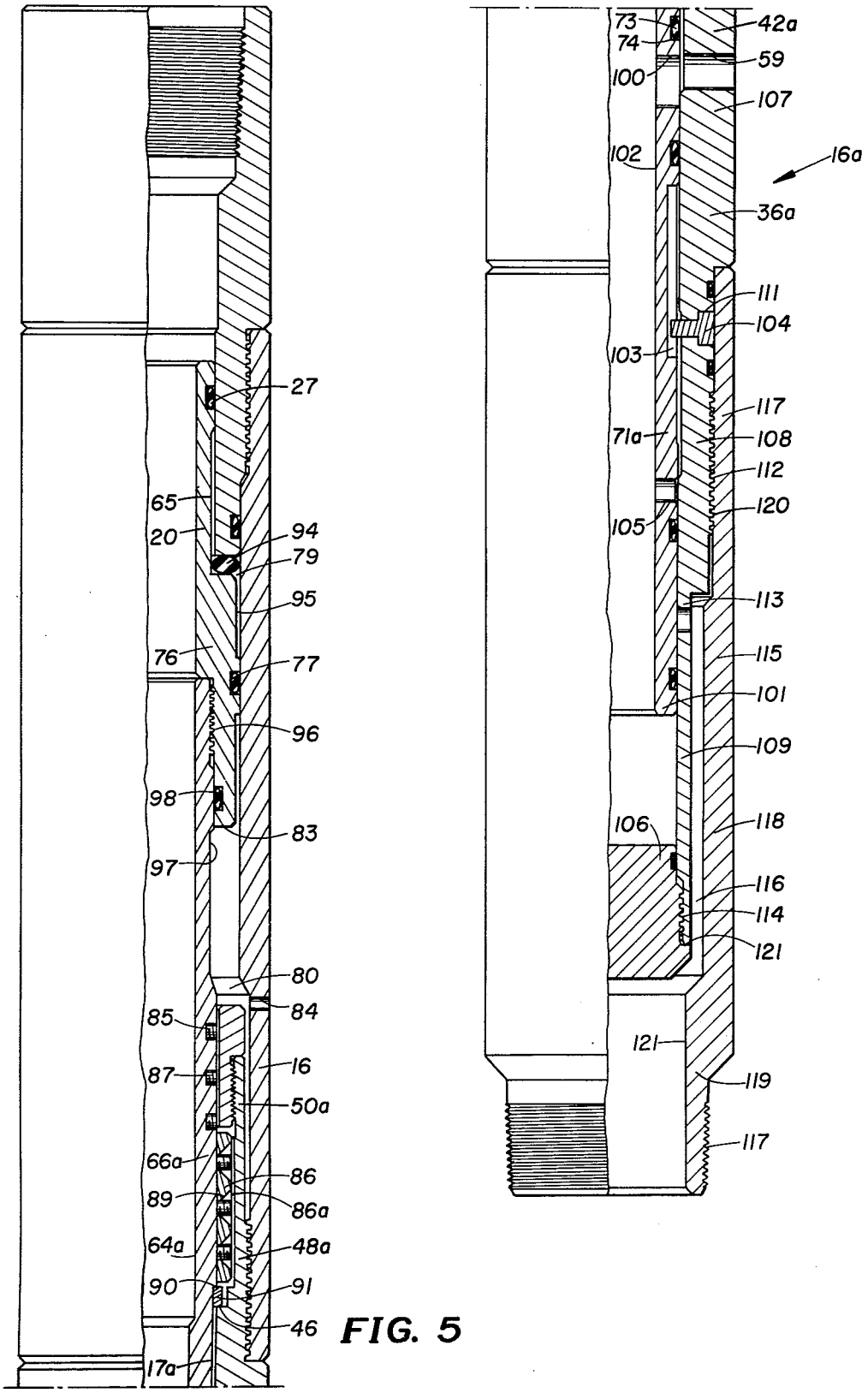
FIG. 5, a right side only cross-sectional view of the embodiment of FIG. 4 in a locked open position.

Looking now to FIGS. 4 and 5, it will be understood that the operation of the valve 9*a* is as described above for FIG. 2 with respect to the portion of valve 9*a* above circulation port 59. However, in valve 9*a* mandrel 17*a* also includes one or more tester ports 105 each in communication with a corresponding tester port 113 in housing 16. When plug 106 is installed in lower end 121 of nipple 107 and mandrel 17*a* moves upwardly in response to annulus pressure exceeding a predetermined magnitude tester port 105 moves upwardly out of alignment with tester port 113, thus blocking fluid passage from flow channel 116 into axial bore 102, thus isolating interior of the portion of pipe string 1 below tester port 113 from axial bore 102 and the interior of the portion of pipe string 1 above tester port 113. This isolates the formation so that a closed-in-pressure reading may be taken to help determine the formation's ability to produce.

It will be understood that the shear mechanism 18 described in detail could be replaced by a tension sleeve, collet spring or other equivalent attachment capable of releasing only after a given force is applied thereto. Also, it will be understood that the lock 19, which is described operates by means of a contracting locking ring 91, could be replaced by a ratchet mechanism, or any other device capable of limiting movement to one direction. Also, pressurizing port 84 is optional, since circulation port 59 can allow fluid communication between the same surfaces. Port 84 is a redundancy built in to assure operation. As seen by comparison of FIG. 2 and FIG. 4, annular shoulder 29 is not required, but may be redundantly added as a back-up feature. Similarly, cushions 93 and 94 are not mandatory but are added only for longer life and higher opening pressure capabilities. Many such modifications will suggest themselves to one skilled in the art without departing from the broad scope of this invention.

Whereas the present specification has described in detail two embodiments of the invention, this description has been for purposes of illustration only and it is to be understood that many modifications such as, but in no way limited to, those noted in the preceding paragraph and elsewhere throughout the present specification will suggest themselves to one skilled in the art and may be made without departing from the scope of the invention as defined by the appended claims and the broad range of equivalents to be accorded thereto.

What is claimed is:

1. In a pipe string located in a fluid filled well bore so as to vertically separate said well bore into an annulus region and an axial bore region, said pipe string including a circulation valve, the method of movement of said circulating valve from a first position preventing to a second position allowing fluid communication between said regions, comprising the steps of:

isolating a negligible pressure gas chamber within said pipe string from said axial bore and said annulus region;

pressurizing one of said regions to a pressure of at least a predetermined magnitude above the pressure in said isolated chamber;

unlocking said circulating valve when the pressure in said pressurized region reaches said predetermined magnitude;

moving said unlocked circulating valve from said first position to said second position in response to the pressure in said pressurized region; and maintaining said moved valve in said second position.

2. The method as recited in claim 1, further comprising the step of:

locking said moved valve in said second position so that said moved circulating valve will stay in said second position irrespective of pressure levels in said annulus.

3. The method as recited in claim 1, further comprising the additional step, subsequent to said isolating step and before said moving step, of:

testing an underground formation in response to annulus pressure less than said predetermined magnitude.

4. Apparatus for circulation of well fluids in response to pressure in an isolated portion of an annulus between a pipe string and a surrounding well bore, comprising:

a. a hollow cylindrical housing having a recess communicating with the isolated portion of the annulus, an axial interior bore, a passageway communicating the axial interior bore with the annulus, and means for connecting the housing in said pipe string;

b. a valve body carried by said housing and at least partially overlying the recess and movable between a first position closing said passageway and a second position opening said passageway;

c. a first locking means for locking said valve body in said first position to said housing and for releasing said valve body from said housing upon a predetermined force applied to said valve body; and d. piston means, attached to said valve body, including: seal means for sealingly contacting said recess so as to divide said recess into a negligible pressure compressible chamber isolated from both said axial bore and said annulus, and an annulus pressure chamber isolated from said axial bore but communicating with said isolated portion of said annulus and differential means for applying said predetermined force upon said valve body urging said valve body toward said second position in response to a predetermined higher pressure in said annulus pressure chamber than in said isolated negligible pressure chamber.

5. The apparatus of claim 4, further comprising:

a. a second locking means, engaging said housing and said valve body, for locking said valve body in said second position upon said valve body reaching said second position.

6. The apparatus of claim 5, wherein said first locking means further comprises a shear collar frangibly attached to said valve body restraining movement of said valve body with respect to said housing; and said second locking means comprises a locking ring encircling said valve body and located in the wall of said housing, and a ledge on said valve body adapted to engage said locking ring, when said valve body is in said second position, thereby restraining said valve body in said second position.

7. The apparatus as recited in claim 4, wherein said cylindrical housing has a recessed portion, and wherein:

a. said valve body is a cylindrical sleeve; and b. said piston means comprises:

i. a ledge on said cylindrical sleeve, said ledge being disposed within and dividing the recess of said recessed portion into a first section communicating with said annulus and a second isolated section and movable within said recess in response to said pressure; and ii. sealing means, between said recessed portion and said ledge.

* * * * *